US007527494B2

(12) United States Patent
Viggiani

(10) Patent No.: US 7,527,494 B2
(45) Date of Patent: May 5, 2009

(54) CANDLE HOLDER AND FLAME EXTINGUISHER DEVICE

(75) Inventor: Anthony Viggiani, Southwest Ranches, FL (US)

(73) Assignee: Eclipse Home Decor, LLC, Delray Beach, FL (US)

( * ) Notice: Subject to any disclaimer, the term of this patent is extended or adjusted under 35 U.S.C. 154(b) by 186 days.

(21) Appl. No.: 11/472,491

(22) Filed: Jun. 21, 2006

(65) Prior Publication Data

US 2007/0298358 A1 Dec. 27, 2007

(51) Int. Cl.
*F23N 5/00* (2006.01)

(52) U.S. Cl. ..... 431/35; 431/292; 431/290; 431/294; 431/296

(58) Field of Classification Search ..... 431/35, 431/290, 292, 296, 289, 294; D26/6
See application file for complete search history.

(56) References Cited

U.S. PATENT DOCUMENTS

| | | | |
|---|---|---|---|
| 117,763 | A | 8/1871 | Fritsch |
| 126,765 | A | 5/1872 | William |
| 141,066 | A | 7/1873 | Morgan |
| 434,298 | A | 8/1890 | Roell |
| 952,935 | A | 3/1910 | Nott |
| 2,213,203 | A | 9/1940 | Buchman |
| D244,056 | S | 4/1977 | Jimenez et al. |
| 6,152,728 | A | 11/2000 | Griffel |

OTHER PUBLICATIONS

Clever Gear Catalog, Holiday 2005. See front cover and p. 2 (Rope candle).*

* cited by examiner

*Primary Examiner*—Alfred Basichas
(74) *Attorney, Agent, or Firm*—Lieberman & Bransdorfer, LLC

(57) ABSTRACT

A device to regulate the burning of a candle is provided using a passive extinguisher that requires no mechanical parts or human intervention. The device is formed as tongs that form, when closed, a hollow cylindrical extension that can securely hold a burning candle. When the burning candle burns into the cylindrical extension, the flame is extinguished by operation of oxygen deprivation.

12 Claims, 4 Drawing Sheets

CANDLE HOLDER AND FLAME EXTINGUISHER DEVICE

FIELD OF THE INVENTION

The present invention relates to a device for holding a candle that extinguishes a burning wick without mechanical or human interaction

BACKGROUND OF THE INVENTION

Burning a candle presents an obviously safety hazard. Candles have an open flame burning from a wick and melted wax. The flame may overheat more wax than is needed to burn and cause the liquid hot wax to drip down from the top of the candle. If the dripping wax caught fire or if the candle tipped over indoors, a potential house fire could result.

Technology to improve the utilitarian aspects of burning a candle include various devices for holding a candle and automatically extinguishing the flame using mechanical means. Some devices attempt to automatically regulate the burning of a candle by using clamps or sharp edges, combined a moving or spring-loaded mechanism to cut off the burning wick when the wax candle burns down to a pre-set level. Some may snuff out the candle from lowering a device onto the burning wick once the candle recedes to a certain height. These mechanisms control the wick of the candle by loading a candle into either a spring-activated slide that cuts off the burning wick when the candle wax recedes below the trigger and releases the spring or attempt to extinguish the flame by a cup or plate above the candle that lowers down to the wick as the wax of the candle melts and burns away. However, these types of devices are subject to numerous problems and problematic assumptions. Spring-loaded clamps are assumed to work but may or may not close and cut the wick properly. The candle may burn lop-sided that either holds the mechanism open too long for the cutting part to properly extinguish the flame or will not allow a device to lower adequately and snuff out the flame.

Other candle holders attempt to extinguish a candle flame passively without using mechanized or spring-loaded slides against extinguish the wick. However, the prior devices create a potential fire hazard by not providing a passive candle extinguisher that provides an adequate enclosure around a burning candle so when the candle burns down, the flame is deprived of oxygen and extinguishes.

What is needed is a simple and reliable holder for a candle that consistently and automatically extinguishes the flame reliance on moving parts of mechanical extinguisher devices. The holder should extinguish a candle flame passively by the candle burning down into an enclosure that then suffocates the flame due to lack of oxygen.

SUMMARY

The present invention, as described in the preferred and alternative embodiments, includes a two-piece holding device that securely holds a cylindrically-shaped wax or similar candle. The two pieces are connected by a rod on a stand and by a spring that holds the two pieces together. A candle is held securely, yet allows a user to manually open the holder and to adjust the candle length held in the holder by freely passing it through a holed area without damaging the candle. The wo parts of the holding device are rotated about a pin joint similar to a pair of tongs or scissors. The spring maintains pressure against each of the two parts of the holding device such that the device is normally closed. When the two tongs of the device are closed, each part forms half of a bowl section that catches dripping wax from the candle.

The embodiments of the present invention also regulate the burning of a candle using a passive extinguisher that requires no mechanical parts or human intervention. A hole in the holding device is formed in the bowl when the two movable parts are closed. Each movable part forms half of the bowl and therefore half of the hole. Underneath the holding device, when the clamp is oriented properly with the top, bowl-side facing away from the ground, the hole is formed out of a both halves of a cylindrical extension on each part of the holding device. The extension is formed as a nearly-straight hollow cylinder away from the device's bowl area. When the holding device is opened, the cylindrical extension halves open in two at which time they may be positioned on either side of a candle and then closed, thereby securing the candle inside the cylindrical extension. When the candle burns down inside extension, the lack of adequate oxygen in the enclosed space to fuel the burning wick causes the flame to extinguish.

BRIEF DESCRIPTION OF THE DRAWINGS

For a better understanding of the nature of the present invention, its features and advantages, the subsequent detailed description is presented in connection with accompanying drawings in which.

DETAILED DESCRIPTION OF THE INVENTION

Figure 1:
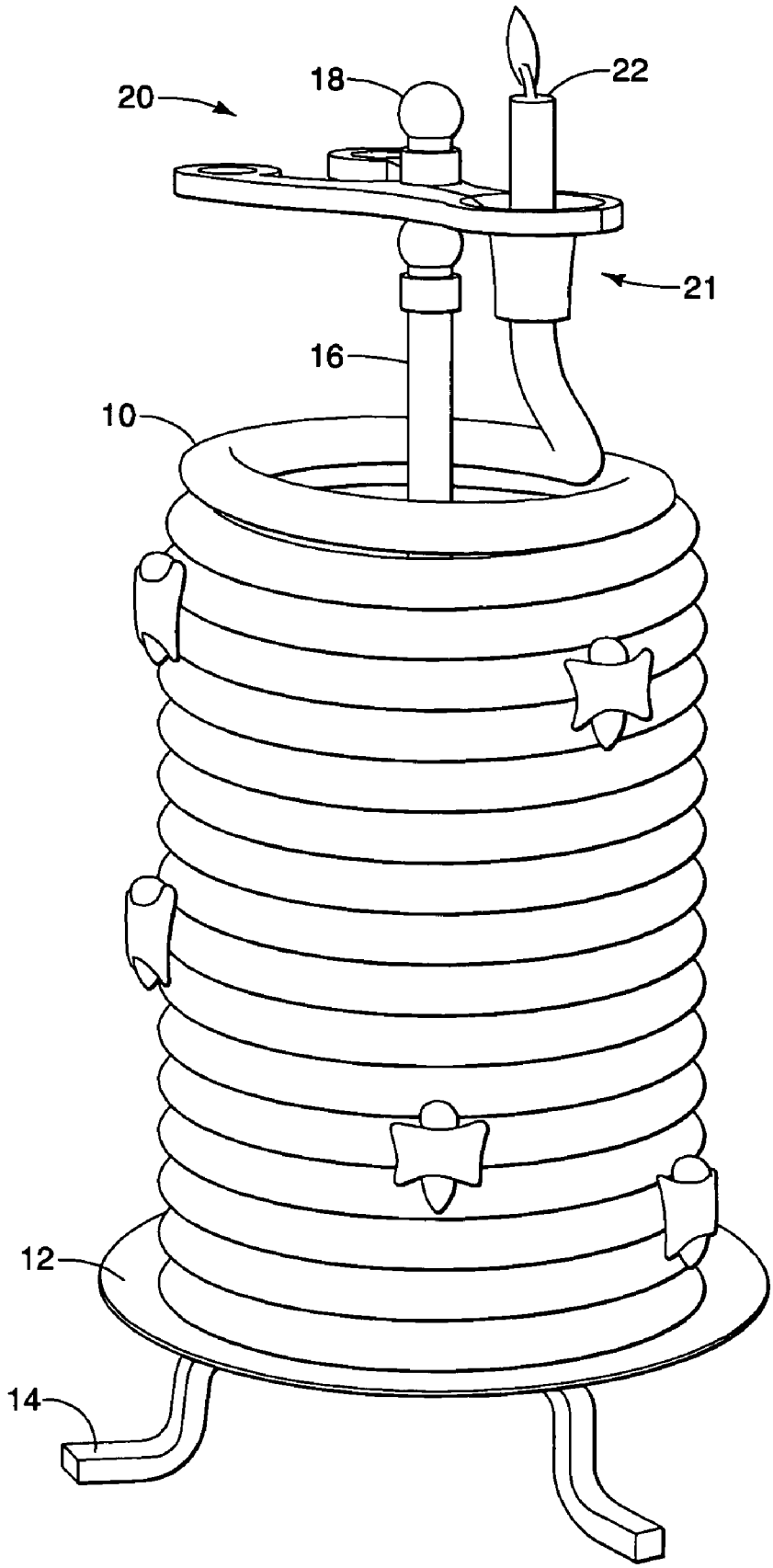
FIG. 1 is a diagram of the preferred embodiment for a candle holder with a candle that are both mounted on a stand.

Referring to FIG. 1, the preferred embodiment of a candle holder 20 with a passive flame extinguisher is illustrated while mounted on a stand. A candle 10 is coiled upon a base 12 that is elevated from a surface by a plurality of legs 14 attached to the base 12. A rod 16 is attached to base 12 and rises vertically such that it remains in-place with adequate rigidity and strength to support holder 20. Candle 10 is cylindrically shaped but flexible to allow it to coil around rod 16 and stack up vertically upon itself. Candle holder device 20 is attached to rod 16, near the end distal to base 12, and held in place by cap 18. Candle holder 20 is preferably attached so that it is supported underneath the holder on the rod, to prevent the holder 20 from dropping down the rod, and allows holder 20 to support and end of candle 10. The holder 20 should swivel around rod 16 to provide rotational adjustment when drawing candle 10 up from the base 12.

Figure 2:
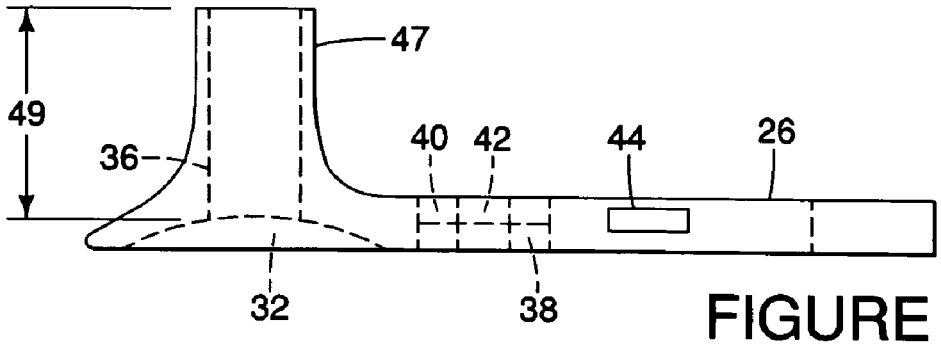
FIG. 2 is a side elevation diagram of the one part of the preferred embodiment for a candle holder.
Figure 3:
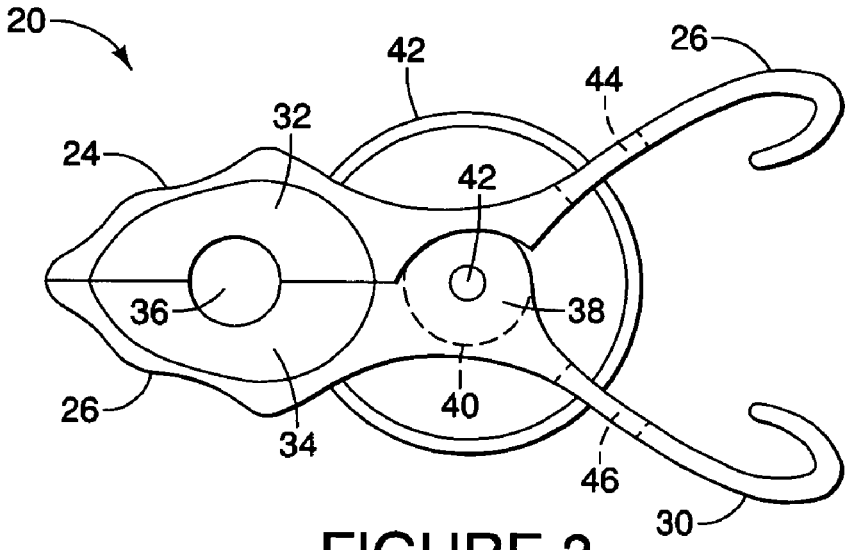
FIG. 3 is a plan elevation diagram of the combined parts for the preferred embodiment for a candle holder.

FIG. 3 shows an elevation plan of exemplary candle holder device 20 constructed as a clip comprises of two halves, or tongs, the first tong comprising a first head part 24 connected to arm 26 and the second tong comprising a head part 28 connected to arm 30. Both parts 24 and 28 are slidably assembled by rotational joints 38 for part 28 that slides over rotational joint 40 of part 24. When aligned, both joint parts create hole 42 that receives mounting rod 16. This is further illustrated in elevation plan views in FIGS. 2 and 4. Joint 40 slides underneath joint 38 to create a rotational joint of clip 20 that is mountable to rod 16. Part 24 and part 28 are held together in a normally closed position by spring element 42 that is a single semi-circular wire applying tension against each of parts 24 and 28. One end of spring 42 is secured to part 24. It then passes freely through arm 26 at opening 44 and passes freely through arm 30 at opening 46 after which it attaches part 28 as shown in the FIG. 3. Arm openings 44 and 46 form rectangular openings that allow the element 42 to move back and forth when the clip 20 is manually opened by squeezing arms 26 and 30 together.

In order to catch wax dripping from a candle, the head of each of the tongs forming the holding device 20 forms a bowl. Part 24 is formed with a semi-circular bowled part 32 that combines with the semi-circular bowled part 34 of head part 28. When held together with spring 42, the two parts 32 and 34 come together to form a bowl. In profile view of FIG. 4, the base edge of bowl 34 is shown in hidden lines and in FIG. 2, the base edge of bowl 32 is shown with hidden lines. Bowl parts 32 and 34 each have a semi-circular area cutout at the bottom of the bowl so that when the two head parts are closed together, a hole 36 is formed that can receive and hold a candle.

Figure 4:
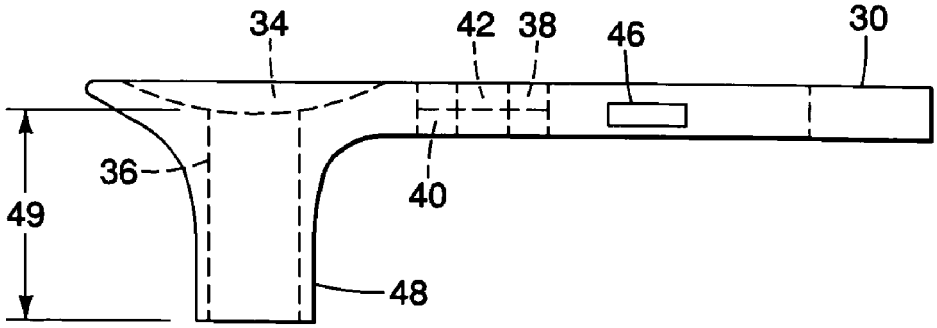
FIG. 4 is a side elevation diagram of one part of the preferred embodiment for a candle holder.

Under the device 20, each head part forms one-half of a cylindrical extension that forms the hole 36. FIG. 4 illustrates the side view of part 28, where the half cylindrical extension 48 extends in a taper away from bowl part 34. Hole diameter 36 is shown with hidden lines. FIG. 2 illustrates an inverted side elevation of part 24 and arm 26. Part 24 has cylindrical extension half 47 extending away from bowl 32. When extension members 47 and 48 are brought together by closing parts 24 and 28, a cylindrical extension 21 is formed creating hole 36 from its hollow interior that can receive and securely clamp a candle. This is shown in FIG. 1.

A burning candle placed in extension 21 will eventually recede in length to a point where the wick is burning from inside of the extension 21. FIG. 1 illustrates a portion of candle 10 held securely in the cylindrical member 21, which is formed by each part 47 and 48 clamping together around the candle 10. Additional lengths of candle 10 may be subsequently drawn through extension 21 by squeezing arms 26 and 30 together manually, thereby opening the head parts 24 and 28, and pulling a portion of coiled candle 10 to an upright position. A portion of candle 10 is positioned between cylindrical extension halves 47 and 48 and the handles 26 and 30 released. Extension halves 47 and 48 close on opposite sides of a candle portion and thereby secure the candle in holding device 20.

After the wick of candle 10 is lit, the portion of candle 10 held by holder 20 will burn down into the cylindrical member 21. Hot wax dripping from the candle will collect in the bowl area formed by parts 32 and 34 around the candle portion. After burning down the exposed portion of coiled candle 10 into cylindrical member 21, the flame will experience oxygen deprivation and extinguish itself. Cylindrical extension member 21 must extend an adequate length 49 from bowl parts 32,34 so that when a candle burns down into the interior of the cylinder, the flame experiences oxygen depravation and extinguishes passively. Extinguishing therefore occurs without any further mechanism or manual interaction.

An important aspect of cylindrical extension member 21 is the length of the formed cylinder 49 extending from bowl parts 32 and 34. If the extension 21 has a length 49 that is too short, then a candle flame will not experience adequate oxygen deprivation to extinguish thereby defeating the purpose of a passive flame extinguisher. For example, candle holders in the prior art have used extensions of approximately one-quarter inch or less, which is an inadequate length to extinguish a typical candle safely. Lengths of greater than ¼ inch of extensions for the preferred and alternative embodiments provide consistent extinguishing of a candle that has a ⅜ inch diameter that is held in a ⅜ diameter hole 80. Thus, an extension length 89 that is at least as long as the diameter of hole 80 is a proper ratio for safely extinguishing flames of a burning candle held by the device. An extension length approximately twice the length of cylindrical extension diameter also provides passive flame extinguishing for the devices of the preferred and alternative embodiments. For example, an extension member 21 with a 5/16 inch diameter candle in hole 36 would cause a normal candle flame to consistently extinguish in a cylindrical member 21 with length 13/16 inches long 49. Exact lengths of extension 21 can vary according to the type of candle wax used in a candle for the present device and a type of wick. Generally, a length 49 of approximately a quarter-inch or less was found not to consistently extinguish a burning candle flame passively and therefore created a risk of burning through the holder 20 creating a fire hazard.

Figure 5:
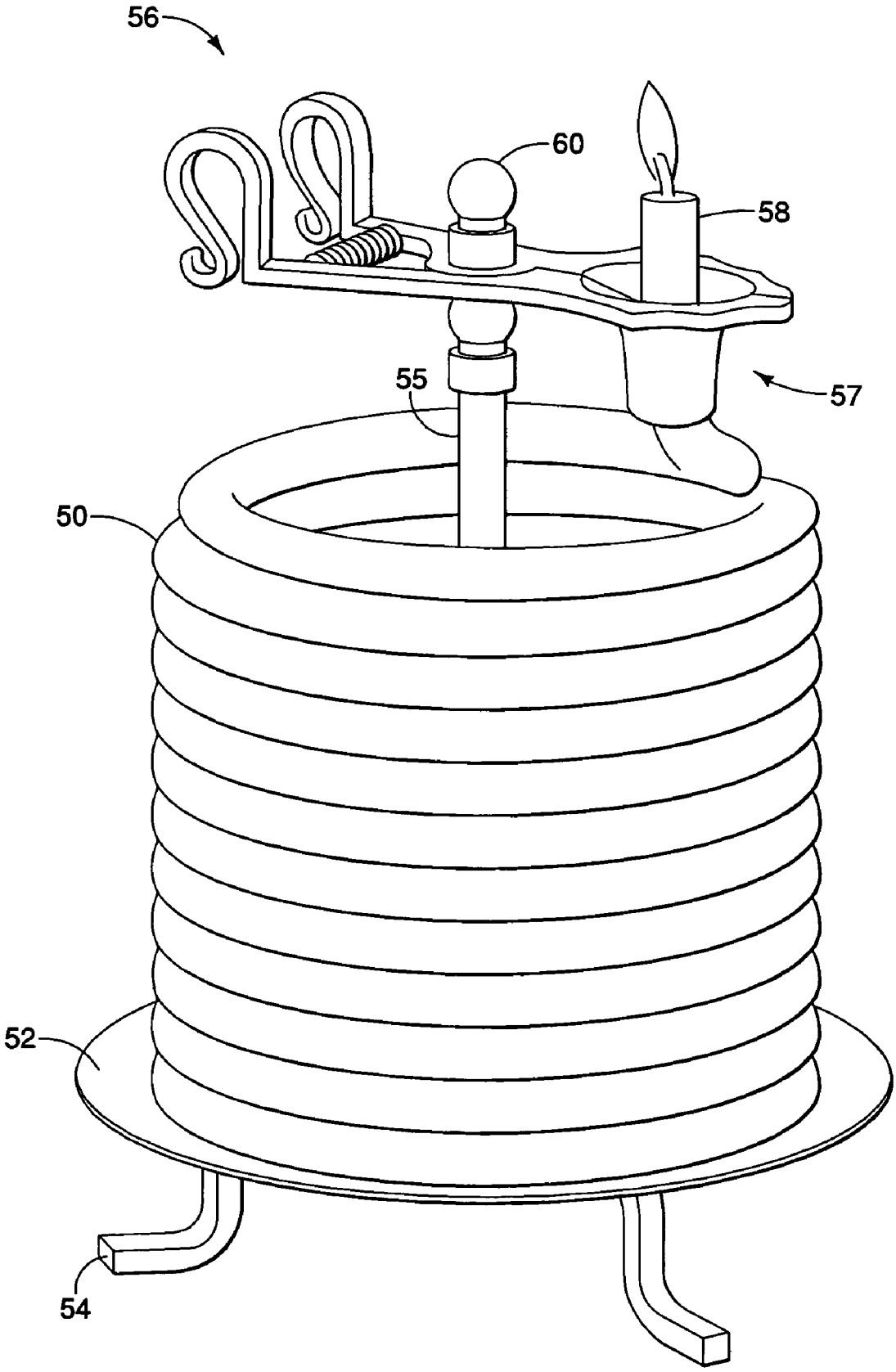
FIG. 5 is a diagram of an alternative embodiment for a candle holder with a candle that are both mounted on a stand.

Referring to FIG. 5, an alternative embodiment of a candle holder 56 with a passive flame extinguisher is illustrated while mounted on a stand. A candle 50 is coiled upon a base 52 that is elevated from a surface by a plurality of legs 54 attached to the base 52. A mounting rod 55 is attached to base 52 and rises vertically such that it remains in-place with adequate rigidity and strength to support holder 56. Candle 50 is cylindrically shaped but flexible to allow it to coil around rod 55 and stack up vertically upon itself. Candle holder device 56 is attached to rod 55, near the end distal to base 52, and held in place by cap 60. Candle holder 56 is preferably attached so that it is supported underneath the holder on the rod 55, to prevent the holder device from dropping down the rod, and allows holder 56 to support and an end of candle 58. The holder 56 should swivel around rod 55 to provide rotational adjustment when drawing candle 50 up from the base 52.

Figure 6:
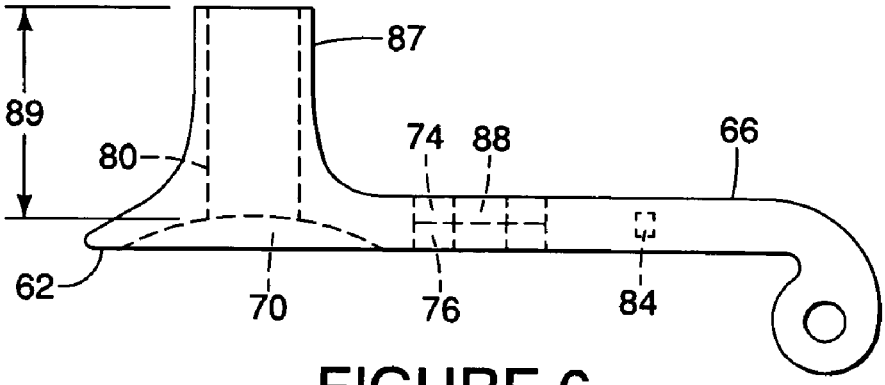
FIG. 6 is a side elevation diagram of the one part of the alternative embodiment for a candle holder.
Figure 7:
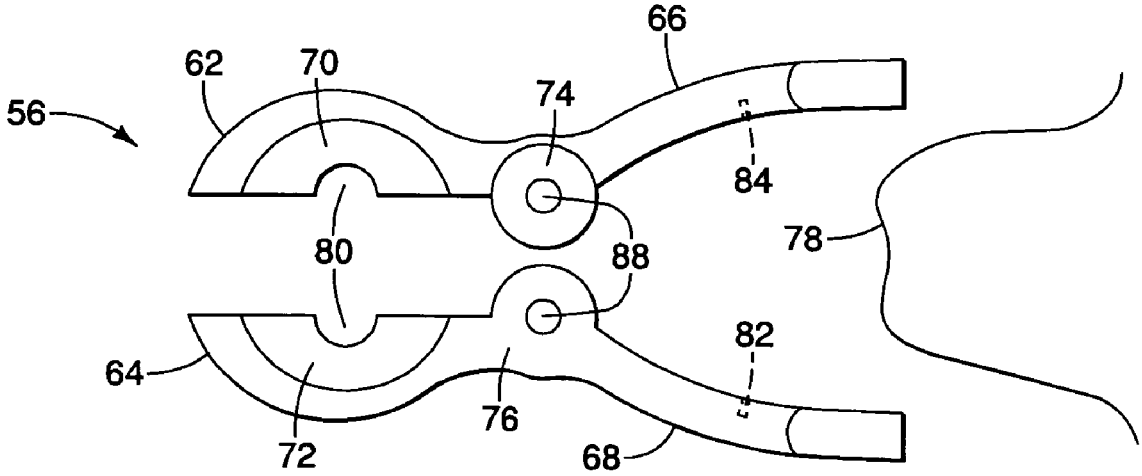
FIG. 7 is a plan elevation diagram of the combined parts for the alternative embodiment for a candle holder.

FIG. 7 shows an elevation plan of exemplary candle holder device 56 constructed as a clip comprises of two halves, or tongs, the first tong comprising a first head part 62 connected to arm 66 and the second tong comprising a head part 64 connected to arm 82. Both parts 62 and 64 are slidably assembled by rotational joints 76 for part 64 that slides over rotational joint 74 of part 62. When aligned, both joint parts create hole 88 that receives mounting rod 55. This is further illustrated in elevation plan views in FIGS. 6 and 8. Joint 74 slides underneath joint 76 to create a rotational joint of clip 56 that is mountable to rod 55.

Head parts 62 and 64 are held together in a normally closed position by spring element 78 that is preferably a bent U-shaped wire applying a biased force against each of the handle arms 84 and 82. One end of spring 78 is inserted into arm 77 at indent 84 and the opposite end is inserted into arm 68 at indent 82. Arm indents 82 and 84 form openings that allow the spring 78 to move when the clip 56 is manually opened by squeezing arms 66 and 82 together.

In order to catch wax dripping from a candle, the head of each of the tongs forming the holding device 56 forms a bowl. Head part 62 is formed with a semi-circular bowled part 70 that combines with the semi-circular bowled part 72 of head part 64. When held together with spring 78, the two parts 62 and 64 come together to form a bowl. In profile view of FIG.

8, the base edge of bowl 72 is shown in hidden lines and in FIG. 6, the base edge of bowl 70 is shown with hidden lines. Bowl parts 70 and 72 each have a semi-circular area cutout at the bottom of the bowl so that when the two head parts are closed together, a hole 80 is formed that can receive and hold a candle portion 58.

Figure 8:
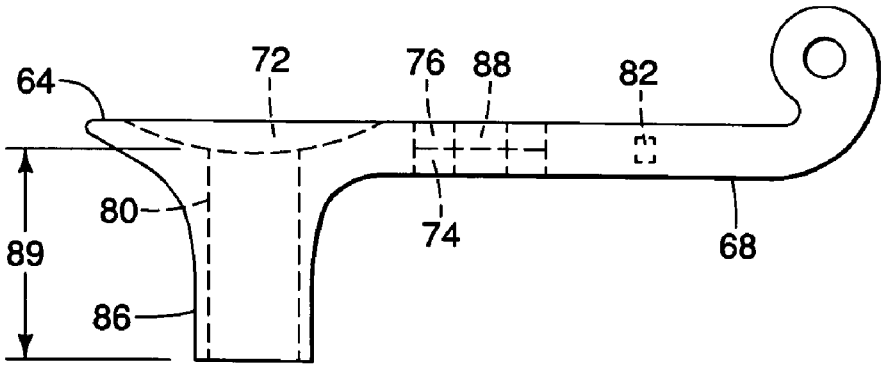
FIG. 8 is a side elevation diagram of one part of the alternative embodiment for a candle holder.

Each head part forms one-half of a cylindrical extension 57 that extends from under the device 56 and forms the hole 36. FIG. 8 illustrates the side view of part 64, where the half cylindrical extension 86 extends in a taper away from bowl part 72. Hole diameter 80 is shown with hidden lines. FIG. 6 illustrates an inverted side elevation of the other tong comprising head part 62 and arm 66. Part 62 has cylindrical extension half 87 extending away from bowl 70. When extension members 86 and 87 are brought together by closing parts 62 and 64, a cylindrical extension 57 is formed, thereby creating hole 80 from its hollow interior that can receive and securely clamp a candle 58. This is shown in FIG. 5.

A burning candle placed in extension 21 will eventually recede in length to a point wherethe wick is burning from inside of the extension 21. FIG. 1 illustrates a portion of candle 10 held securely in the cylindrical member 21, which is formed by each part 47 and 48 clamping togetheraround the candle 10. Additional lengths of candle 10 may be subsequently drawnthrough extension 21 by squeezing arms 26 and 30 together manually, thereby opening the head parts 24 and 28, and pulling a portion of coiled candle 10 to an upright position. A portion ofcandle 10 is positioned between cylindrical extension halves 47 and 48 and the handles 26 and 30 released. Extension halves 47 and 48 close on opposite sides of a candle portion and thereby securethe candle in holding device 20.

After the wick of candle 50 is lit, the portion 58 held by holder 56 will burn down into the cylindrical member 57. Hot wax dripping from the candle will collect in the bowl area formed by parts 70 and 72 around the candle portion. After burning down the exposed portion of coiled candle 50 into cylindrical member 57, the flame will experience oxygen deprivation and extinguish itself. Cylindrical extension member 57 must extend an adequate length 89 from bowl parts 70 and 72 so that when a candle burns down into the interior of the cylinder 57, the flame fully extinguishes. Extinguishing therefore occurs without any further mechanism or manual interaction.

An important aspect of cylindrical extension member 57 is the extending length 89 as shown in FIGS. 6 and 8. If the extension 57 has a length 99 that is too short, then a candle flame will not experience adequate oxygen deprivation to extinguish, thereby defeating the purpose of a passive flame extinguisher. For example, candle holders in the prior art have used extensions of approximately one-quarter inch or less, which is an inadequate length to extinguish a typical candle safely. Lengths of greater than ¼ inch of extensions for the preferred and alternative embodiments provide consistent extinguishing of a candle that has a ⅜ inch diameter that is held in a ⅜ diameter hole 80. Thus, an extension length 89 that is at least as long as the diameter of hole 80 is a proper ratio for safely extinguishing flames of a burning candle held by the device. For example, an extension member 57 with a 5⁄16 inch diameter hole 80 would also allow an average candle flame from a 5⁄16 inch candle to consistently extinguish in a cylindrical member 57 with a length of 13⁄16 inches.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed:

1. A device for extinguishing a burning candle, comprising:

a first section comprising a head part, connected to a joint part, the joint part being connected to an arm;

a second section comprising a head part, connected to a joint part, the joint part being connected to an arm, wherein the first joint part and the second joint part slidably connect the first section and the second section as tongs;

a spring formed as a wire having two ends, connected to the first head part at the first end of the spring and connected to the second head part at the second end of the spring, wherein a force from the spring maintains the first head part and the second head part normally closed against each other, wherein each head part comprises a semi-circular bowl that extends an approximate equal distance away from the head part, and wherein when each head is closed against one another, each semi-circular bowl close together to form a bowl with a base having an aperture to hold a burning candle securely and the bowl is of a height that when the burning candle burns down into the bowl height, the flame is extinguished by operation of oxygen deprivation.

2. The device of claim 1, wherein the bowl is formed by each semi-circular bowl having a length equal to or longer than the approximate diameter of the bowl.

3. The device of claim 1, wherein each half of the bowl extends in a perpendicular direction away from each section of the device such that when device is mounted horizontally on a stand and each arm is held together, the semi-circular bowl will open and a candle may be drawn up to be held by the bowl from below the device.

4. The device of claim 1, wherein the bowl is formed by each semi-circular bowl having a length greater than approximately one-quarter of an inch for a ⅜ inch diameter bowl.

5. The device of claim 1, wherein the bowl is formed by each semi-circular bowl having a length equal to or greater than approximately 13⁄16 inches for a 5⁄16 inch diameter bowl.

6. The device of claim 1, wherein the bowl is formed by each semi-circular bowl having a length of approximately twice a diameter of the bowl.

7. A device, comprising:

two separable halves of tongs to hold a candle, each half comprising:

a section comprising a head part;

a joint part, connected to the head part, that forms a hole when the two halves are assembled for placing the device onto a stand;

an arm, connected to the joint part, for opening the tongs;

a spring formed as a wire having two ends, connected to each head part at the first end of the spring, wherein a force from the spring maintains the tongs normally closed against each other, wherein each head part comprises half of a cylindrical extension that extend an approximate equal distance away from the head part, and wherein when each head is closed against one another, each cylindrical extension half close together to form a hollow cylindrical member with vertical walls and a bottom wall in communication with the vertical walls, the formed cylindrical member to that hold a burning candle securely and is of a length that when the burning candle burns down into the cylindrical extension, the flame is extinguished by operation of oxygen deprivation.

8. The device of claim 7, wherein the cylindrical member is formed by each cylindrical extension half having a length equal to or longer than the approximate diameter of the cylindrical member.

9. The device of claim 7, wherein each half of the cylindrical extension extends in a perpendicular direction away from each section of the device such that when a device is mounted horizontally on a stand and each arm is held together, the cylindrical extension halves will open and a candle may be drawn up to be held by the cylindrical member from below the device.

10. The device of claim 7, wherein the cylindrical member is formed by each cylindrical extension half having a length greater than approximately one-quarter of an inch for a 3/8 inch diameter cylindrical member.

11. The device of claim 7, wherein the cylindrical member is formed by each cylindrical extension half having a length equal to or greater than approximately 13/16 inch for a 5/16 inch diameter cylindrical member.

12. The device of claim 7, wherein the cylindrical member is formed by each cylindrical extension half having a length of approximately twice a diameter of cylindrical member.

* * * * *